United States Patent [19]

Newby

[11] Patent Number: 4,469,472

[45] Date of Patent: Sep. 4, 1984

[54] PUMP MECHANISM POWERED BY GASEOUS EXPANSION

[76] Inventor: John C. Newby, 41289 Malcolmson St., Fremont, Calif. 94538

[21] Appl. No.: 399,839

[22] Filed: Jul. 19, 1982

[51] Int. Cl.[3] ..... F04B 21/00

[52] U.S. Cl. ..... 417/61; 417/279

[58] Field of Search ..... 417/52, 207–209, 417/279, 61, 138, 130, 131, 118, 120, 134, 137, 126

[56] References Cited

U.S. PATENT DOCUMENTS

| | | | |
|---|---|---|---|
| 3,087,438 | 4/1963 | Ciesielski | 417/207 |
| 3,285,001 | 11/1966 | Turnblade | 417/130 X |
| 3,898,017 | 8/1975 | Mandroian | 417/65 |
| 3,902,825 | 9/1975 | Quillen | 417/118 |
| 4,181,470 | 1/1980 | Gillett | 417/138 X |

FOREIGN PATENT DOCUMENTS

| | | | |
|---|---|---|---|
| 250664 | 9/1947 | Switzerland | 417/61 |

*Primary Examiner*—Edward K. Look
*Attorney, Agent, or Firm*—Paul L. Hickman

[57] ABSTRACT

A pump mechanism adapted to float on a reservoir of water characterized by a floating enclosure provided with an internal chamber, a float disposed within the chamber of the enclosure, a first valve coupled to the float and adapted to open and close an orifice provided at the top of the enclosure, a refill valve associated with an orifice provided at the bottom of the enclosure, and an output tube opening on the chamber of the enclosure and provided with a check valve to prevent the back flow of water into the chamber. As the air within the chamber expands the water within the chamber is expelled through the output tube causing the enclosure to float higher on the reservoir and the float to float lower within the enclosure. When the water level within the enclosure drops to a predetermined level, valves open to recharge the mechanism with water and cool air.

9 Claims, 7 Drawing Figures

PUMP MECHANISM POWERED BY GASEOUS EXPANSION

BACKGROUND OF THE INVENTION

1. Field of the Invention

This invention relates generally to pumps, and more particularly to pumps powered by the expansion of a gas.

2. Description of the Prior Art

There are a great number of prior art devices which utilize the force of an expanding gas to pump liquids. Usually, the gas used is air and it is expanded by the application of heat energy from a solar or combustion source.

An early solar pump designed by Isaac de Caus in the mid-seventeenth century included a matrix of lenses focused on half filled, sealed tanks of water. As the air within the tanks expanded the water was forced out through pipes. In the mid-nineteenth century, Mouchot designed a solar pump including a sealed, copper cylinder partially filled with water, and a parabolic reflector for focusing sunlight on the cylinder. As the air expanded the water was forced from the cylinder through a one way check valve.

A more modern example of a solar pump is found in U.S. Pat. No. 3,972,651 of Fletcher. The pump includes a hermetically sealed enclosure 11 floating on a reservoir of water. The enclosure includes a solar heated chamber 48 and a cooling chamber 50 which communicate through a plurality of heat sinks 54. At the bottom of the enclosure 11 there is a sump 20 which is in communication with the reservoir of water via a one way valve 28. When the air in heated chamber 48 expands it will flow through the heat sinks 54 into the cooling chamber and exert pressure on the water in sump 20 to force it up a conduit 34 to an output flume 42. Fletcher's device is metered by a tipple 60 which is filled by dribbles of water from the flume. When the tipple 60 is filled with water it will tip over, raising a 'displacer' 44 which separates the chambers 48 and 50. This cools the air within the enclosure and causes water to flow into the sump through valve 28. When the tipple empties the displacer falls and the cycle is repeated.

Fletcher's device is an example of a closed system solar pump, that is, the same air is used over and over during the expansion and compression cycles and is never vented to the atmosphere. As such, Fletcher's pump has many points of similarity with the Stirling hot air engine, which is a classic example of a closed system heat engine.

A problem with closed system pumps or engines is that their design is complicated by the need for complete pressure integrity, and by the elaborate heat dissipating mechanisms required to cool the air between cycles. For example, most of the complexity in Fletcher's device is found in the displacer and tipple mechanism which cools the air within the enclosure. Similarly, a Stirling hot air engine requires water jackets around the compression cylinder and/or an elaborate array of heat radiating fins.

SUMMARY OF THE INVENTION

An object of this invention is to provide an inexpensive and reliable solar powered pump.

Another object of this invention is to provide a pump that is powered by the expansion force of a gas.

A still further object of this invention is to provide a pump where neither complete pressure integrity nor elaborate cooling mechanisms are required.

Briefly, the invention includes a hollow enclosure floating on a reservoir of water, a float disposed within an internal chamber of the enclosure, a first valve coupled to the float and adapted to open and close an orifice provided at the top of the enclosure, a refill valve associated with an orifice provided at the bottom of the enclosure, and an output tube opening on the chamber and provided with a check valve to prevent the back flow of water into the chamber. As the air within the chamber expands the water within the chamber is expelled through the output tube causing the enclosure to float higher on the reservoir and the float to drop within the enclosure. When the water level within the enclosure drops to a predetermined level, the valves open to recharge the mechanism with water and cool air.

An advantage of the present invention is that it is an open system mechanism, i.e. the air is vented to the atmosphere between each cycle. This design allows for simplified construction and reduces or eliminates the need for radiators and/or other air cooling mechanisms.

Another advantage of the present invention is that its unique design of a float within a float efficiently utilizes heat energy and the forces of buoyancy and gravity to recycle the system. Since the enclosure floats high on the reservoir just before it is recharged with water, it will start to sink under the action of gravitational force when the bottom valve is opened. This sinking action will fill the enclosure with water far more rapidly than would be possible by simple siphoning, as taught by the prior art.

Yet another advantage of this invention is that it can be powered by an external pressurized gas source.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
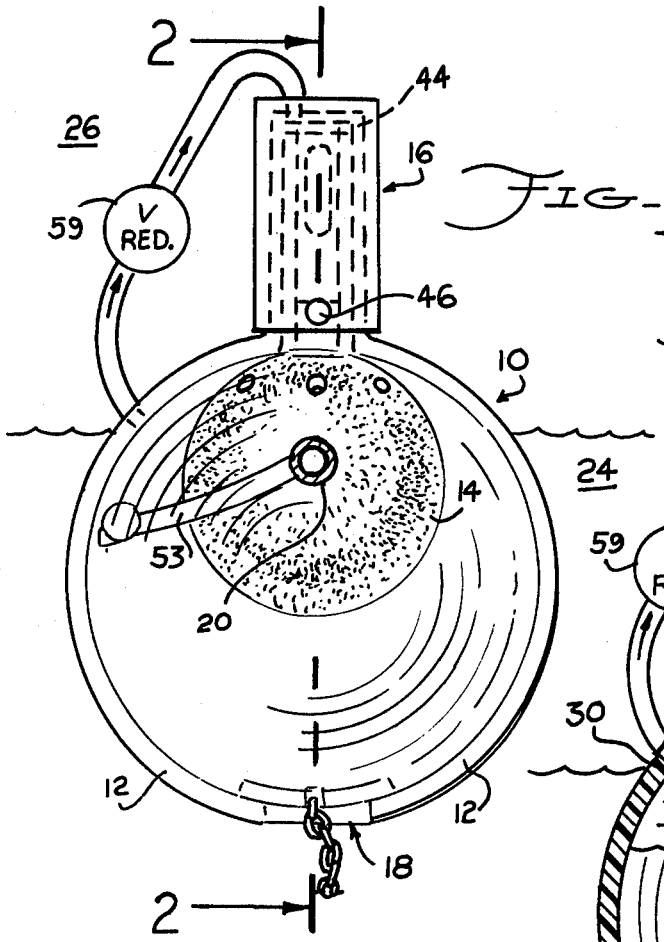
FIG. 1 is an elevational view of a preferred embodiment of the present invention.
Figure 2:
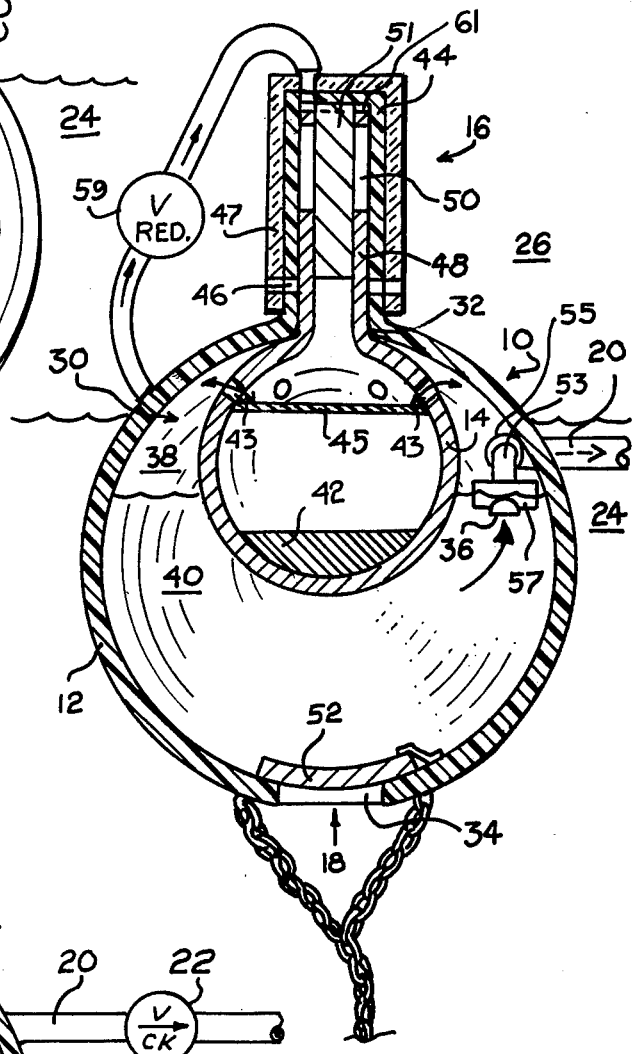
FIG. 2 is a cross section taken along line 2—2 of FIG. 1.
Figure 3:
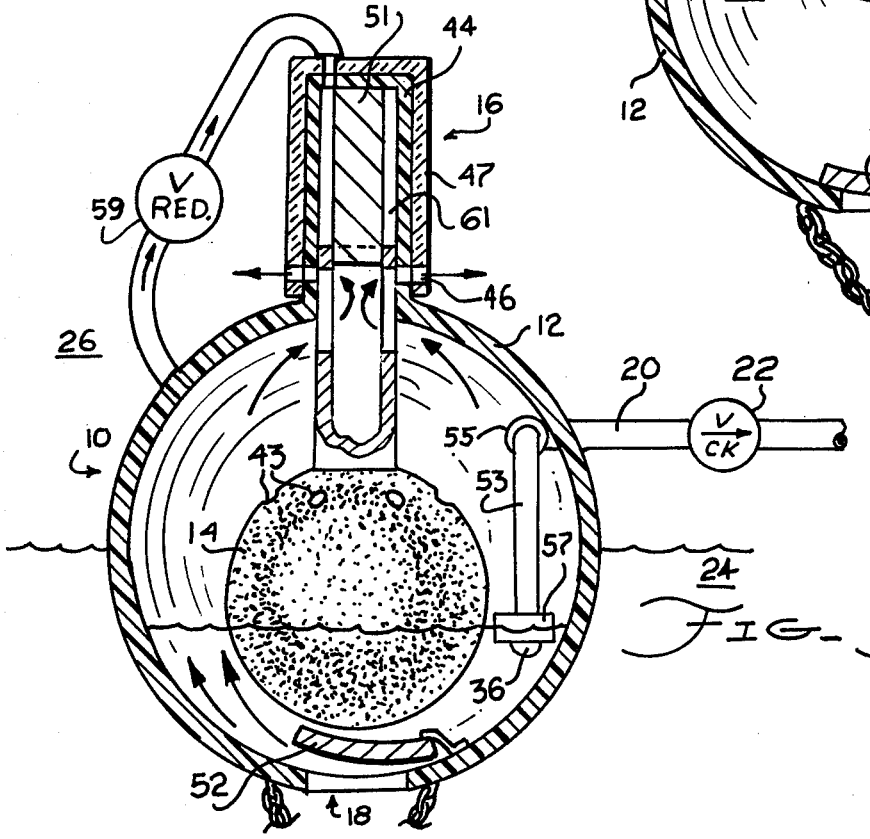
FIG. 3 is the cross section of FIG. 2 with the pump in the recharging portion of its pump cycle.

Referring to FIGS. 1–3, a pump mechanism 10 in accordance with the present invention includes an enclosure 12, a cycling float 14, an upper or air valve 16, a lower or water valve 18, and an output pipe 20 provided with a one-way check valve 22. The enclosure half floats on a reservoir of liquid such as water 24 such that an upper portion is exposed to the atmosphere 26 (or any other type of gaseous reservoir) and a lower portion is immersed in water 24.

Referring more particularly to FIG. 2, the enclosure 12 is hollow sphere, but it can be made in any suitable shape. Enclosure 12 is preferably transparent to infra-red radiation. The enclosure 12 is preferably provided with a three orifices allowing communication between its internal chamber 30 and the surrounding environment, namely a gas orifice 32, a liquid orifice 34, and an output orifice 36. As noted, the upper half of chamber 30 is filled with pump air 38 and the lower half of chamber 30 is filled with pump water 40.

Float 14 is hollow and sealed and is preferably weighted such as by lead shot 42. The float is provided with a number of vents 43 to allow pump air 38 to enter its internal chamber. A partition 45 is provided to prevent condensation from filling the float. The external surface of float 14 is preferably pitted and colored black to maximize its heat absorption characteristics to more efficiently heat the pump air within the enclosure.

Air valve 16 includes a cylinder 44 attached to enclosure 12 over gas orifice 32. The cylinder 44 is provided with a number of vents 46 and is preferably covered with a thermally insulating material 47. A hollow piston 48 slides within the cylinder 44 and is provided with elongated slots 50. A cylindrical core 51 attached to the top of cylinder 44 forms an air tight, sliding seal with the inner wall of hollow piston 48. Piston 48 is attached to the top of float 14 and rises and falls with the float.

Water valve 18 includes a flapper type check valve 52 attached to enclosure 12 over water orifice 34. When the pressure within enclosure 12 is greater than or equal to the surrounding pressure the valve will remain closed. When the water pressure surrounding the enclosure is greater than the pressure within the enclosure valve 52 will open.

A floating pipe 53 has one end coupled to output pipe 20 by a swivel coupling 55, and has its other end attached to a float 57. Output orifice 36 is always just below the surface of pump water 40 so as to draw off the hottest pump water first. This increases the efficiency of the pump because the cool pump water 40 remaining cools the pump air 38, allowing for greater thermal expansion.

A pressure reduction valve 59 couples the upper portion of chamber 30 to the small volume 61 surrounding core 51 above piston 48. Pressure reduction valves, which are well known to those skilled in the art, typically have an input line and an output line as shown in the figure. The pressure reduction valve 59 develops a pressure on its output line which is less than the pressure exerted on its input line. Thus, the pressure in volume 61 is usually less than the pressure of the pump air 38. This pressure differential between the air within volume 61 and pump air 38 tends to keep the cycling float 14 from moving downwardly until the level of pump water 40 drops substantially.

Figure 4:
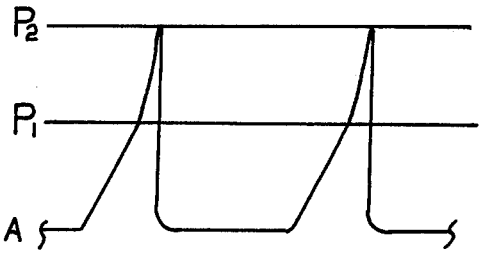
FIG. 4 is a graph of the operating cycle of the invention.

The operation of the present invention will be discussed with reference to FIGS. 2–4. The beginning of the cycle is shown in FIG. 2 with chamber 30 partially filled with pump air 38 and partially filled with pump water 40. As noted, the enclosure 12 is floating rather low in reservoir 24 because of the large quantity of water 40 within the enclosure. As heat (such as from solar radiation) impinges upon the black, pitted surface of the float 14 within the enclosure 12, the pump air 38 expands and forces the pump water 40 out the output orifice 36 and into output pipe 20. As noted in the graph of FIG. 4, the heating of the pump air 38 causes the air pressure within the chamber to rise from the ambient pressure A to a maximum pressure $P_2$. The pump water starts to be pumped at a pressure $P_1$ which is intermediate to pressures A and $P_2$.

As the pump water 40 is expelled from the chamber 30, the entire enclosure 12 starts to float high in the reservoir 24. Float 14 would have a tendency to sink as pump water 40 is expelled, but is held in place by the low pressure within volume 61. When most of pump water 40 is expelled from chamber 30, the weight of the float overcomes the low pressure in volume 61, and the float drops as shown in FIG. 3. The hot, pressurized pump air is vented to the atmosphere through slots 50 and vents 46. The abrupt reduction of pressure from $P_2$ to A allows flapper valve 52 to open and refill the chamber 30, as the entire enclosure 12 begins to sink. Thus, at the end of each cycle the pump air is vented to the atmosphere and replaced with cooler, unpressurized air, and the pump water is returned to its starting level. Check valve 22 prevents a back flow of water into the chamber 30 at this part of the cycle.

It will be noted that the recycling mechanism of this invention utilizes the forces of gravity and bouyancy. The float 14 drops within the enclosure 12 due to a decrease in bouyancy, and the enclosure 12 is rising in reservoir 24 due to an increase in buoyancy. When valves 16 and 18 open, the enclosure is actually sinking under the influence of gravity, and thus quickly drives out the hot, pressurized pump air 38 and quickly draws in the pump water 40.

It will also be noted in FIG. 2 that the enclosure can be tethered to a fixed surface, such as the bottom of the reservoir, such as by a chain 60. Tethering the enclosure is advantageous in fixed level reservoirs since there is no external mechanical movement of the pump mechanism.

Figure 5:
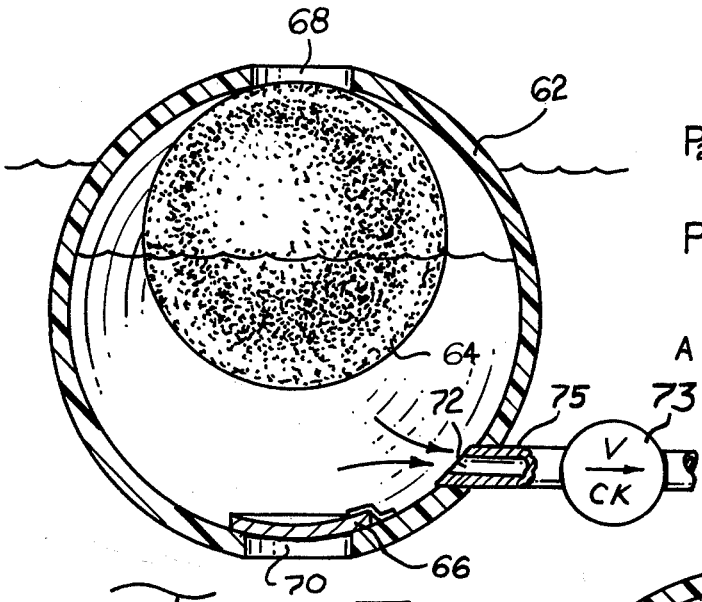
FIGS. 5 and 6 are partial cross sections of an alternate embodiment of the present invention.
Figure 6:
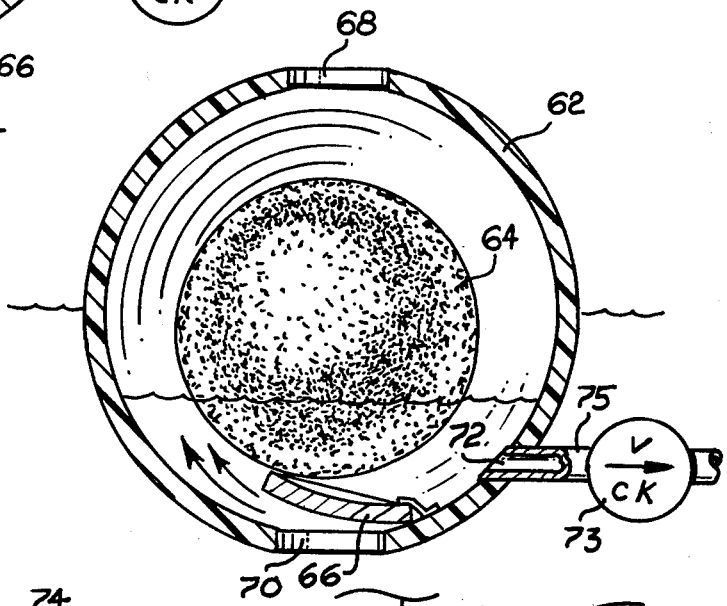

In FIGS. 5 and 6 a simplified, alternate embodiment of the present invention is shown to include a hollow enclosure 62, a float 64 disposed within the enclosure, and a flapper type check valve 66. The enclosure is provided with an upper orifice 68, a lower orifice 70, and an output orifice 72. A check valve 73 is coupled to an output pipe 75 leading from the output orifice 72.

An upper surface of float 64 seats against upper orifice 68 to seal the upper end of the enclosure 62. Flapper valve 66 seals the lower orifice 70 whenever the pressure within enclosure 62 is greater than the water pressure outside of it.

The operation of this alternate embodiment is similar to that described in the preferred embodiment. As heat impinges the outer surface of enclosure 62 the air within the enclosure expands and drives the water out of the enclosure. As the enclosure empties it will become more bouyant and will rise in the reservoir, and simultaneously the float will become less buoyant and will sink within the enclosure 62. When the upper orifice 68 is unsealed, the hot, pressurized air within the enclosure will escape, and flapper valve 66 will open to allow the enclosure 62 to partially sink to its original or starting position.

Figure 7:
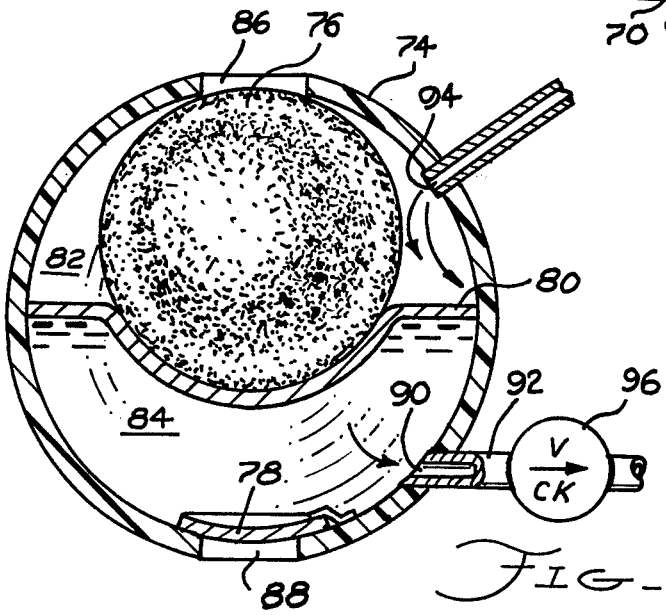
FIG. 7 is a partial cross section of a second alternate embodiment of the present invention.

In FIG. 7 a second alternate embodiment of this invention includes a hollow enclosure 74, a float 76, a flapper valve 78, and a diaphragm 80 separating the pump air 82 from the pump water 84. The diaphragm 80 prevents evaporation and aeration of the water. Enclosure 74 includes an air orifice 86 adapted to engage an upper surface of float 76, a water orifice 88 associated with flapper valve 78, an output orifice 90 for an output pipe 92, and a gas inlet orifice 94 leading to a pressurized source of gas. A check valve 96 is coupled to output pipe 92.

In operation, the gas source exerts a pressure on diaphragm 80 to expel water 84 from the enclosure. As water 84 is expelled the enclosure 74 becomes more buoyant and rises in the reservoir, and the float becomes less buoyant and falls within the enclosure. When the air orifice 86 becomes unsealed the gas pressure within the enclosure drops and the enclosure begins to sink, refilling it with water 84. By using an external gas source the pump will operate far more rapidly than the previous, solar powered embodiments of this invention. This alternate embodiment is advantageous in that it has few moving parts to wear or fail.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A pump mechanism adapted to float at the interface between a reservoir of a liquid and a reservoir of a gas, said pump mechanism comprising:

(a) a floating enclosure provided with an internal chamber, said enclosure further having an upper surface exposed to said gas reservoir, a lower surface exposed to said liquid reservoir, a gas orifice permitting communication between said gas reservoir and said chamber, a liquid orifice permitting communication between said liquid reservoir and said chamber, and an output orifice, whereby a lower volume of said chamber is filled with pump liquid and an upper volume of said chamber is filled with pump gas;

(b) a cycling float located within said chamber and floating on said pump liquid;

(c) first valve means coupled to said cycling float and adapted to close said gas orifice when said pump liquid is above a predetermined level, said first valve means including a slide valve including a vented cylinder member coupled over said gas orifice, and a vented piston member coupled to said cycling float, whereby said slide valve is open when said vents of said cylinder member and said piston member are aligned, and whereby said slide valve is closed when said vents of said cylinder member and said piston member are not aligned;

(d) first check valve means associated with said liquid orifice to allow one way flow of liquid into said chamber; and (e) second check valve means coupled to said output orifice to allow one way flow of pump liquid out of said chamber.

2. A pump mechanism as recited in claim 1 wherein said piston member is partially hollow and wherein said first valve means further comprises an elongated core attached to said cylinder member and slidingly engaged with an inner surface of said hollow piston member.

3. A pump mechanism as recited in claim 2, further comprising a reduction valve coupling said chamber to the volume surrounding said core above said piston.

4. A pump mechanism adapted to float at the interface between a reservoir of a liquid and a reservoir of a gas, said pump mechanism comprising:

(a) a floating enclosure provided with an internal chamber, said enclosure further having an upper surface exposed to said gas reservoir, a lower surface exposed to said liquid reservoir, a gas orifice permitting communication between said gas reservoir and said chamber, a liquid orifice permitting communication between said liquid reservoir and said chamber, and an output orifice, where a lower volume of said chamber is filled with pump liquid and an upper volume of said chamber is filled with pump gas, and where said floating enclosure rises and falls relative the surface of said liquid reservoir as its buoyancy increases and decreases, respectively, due, at least in part, to the amount of pump liquid within said enclosure;

(b) a cycling float located within said chamber and floating on said pump liquid;

(c) first valve means associated with said cycling float and adapted to close said gas orifice when said pump liquid is above a predetermined level; and (d) first check valve means associated with said liquid orifice and adapted to open said orifice to permit the flow of liquid into said chamber when the floating enclosure falls relative the surface of said reservoir due to a decrease in buoyancy.

5. A pump mechanism as recited in claim 4, wherein said first valve means comprises a valve seating surface associated with said gas orifice, and an upper surface of said cycling float adapted to seat with said valve seating surface.

6. A pump mechanism as recited in claim 4 wherein said enclosure is transparent to infra-red radiation, and said float is adapted to absorb infra-red radiation.

7. A pump mechanism as recited in claim 4, further comprising inlet means coupled to said enclosure, and a source of pressurized gas coupled to said inlet means, whereby gas from said pressurized source may flow into said chamber.

8. A pump mechanism as recited in claims 4 or 7 further comprising an elastic barrier attached within said chamber between said pump gas and said pump liquid.

9. A pump mechanism as recited in claim 4 further comprising tethering means attaching said enclosure to a fixed surface, whereby the upward movement of said enclosure is limited.

* * * * *